United States Patent [19]

Hayes

[11] 4,268,392

[45] May 19, 1981

[54] DISPOSABLE PLASTIC TRAP BAG

[75] Inventor: John Hayes, Aurora, Colo.

[73] Assignee: Tiger Manufacturing Company, Englewood, Colo.

[21] Appl. No.: 44,578

[22] Filed: Jun. 1, 1979

[51] Int. Cl.[3] ..... B01D 43/00; E03C 1/18

[52] U.S. Cl. ..... 210/238; 210/513; 210/532.1; 220/404; 4/638; 4/653

[58] Field of Search ..... 210/532 R, 532 S, 299, 210/515, 221, 282, 238; 166/105.3, 105.4, 105.5; 220/404; 4/1, 187 R, 189, 190, 285, 289–292; 264/338; 249/112

[56] References Cited

U.S. PATENT DOCUMENTS

| | | | |
|---|---|---|---|
| 1,648,701 | 11/1927 | Smallbrook | 210/532 R |
| 2,050,091 | 8/1936 | Gibson et al. | 210/532 R |
| 2,467,547 | 4/1949 | Birnbaum | 210/532 R |
| 2,508,761 | 5/1950 | Kroboth | 210/532 R |
| 3,212,644 | 10/1965 | Kemper | 210/532 R |
| 3,559,218 | 2/1971 | Hopkins | 4/187 |
| 3,750,196 | 8/1973 | Halferty | 4/187 R |
| 3,874,006 | 4/1975 | Ritter | 4/189 |

FOREIGN PATENT DOCUMENTS

| | | | |
|---|---|---|---|
| 1533744 | 11/1978 | United Kingdom | 220/404 |

*Primary Examiner*—Charles N. Hart
*Assistant Examiner*—E. Rollins Cross
*Attorney, Agent, or Firm*—Sheridan, Ross, Fields & McIntosh

[57] ABSTRACT

A device is provided for removing and containing debris present in a fluid as the fluid moves through the device. The device includes a cover member attachable to an inlet pipe for receiving the fluid-carrying debris and an outlet pipe for removing the debris-less fluid. A receptacle is removably secured to the cover member while a replaceable trap bag is housed therein to contain the debris that is deposited by the fluid. The trap bag has a longitudinal seal portion which includes a flat seal portion to overlie a portion of the rim of the receptacle. A gasket member underlies the cover member to engage that portion of the trap bag which overlies the receptacle rim, including the flat seal portion. The flat seal portion substantially eliminates leakage of fluid along the longitudinal seal portion of the trap bag since there is virtually no difference in width between the flat seal portion and other portions of the trap bag overlying the rim. Consequently, there is a tight, uniform seal between the gasket member and the trap bag.

4 Claims, 8 Drawing Figures

DISPOSABLE PLASTIC TRAP BAG

DESCRIPTION

1. Technical Field

This invention relates to containers for removing debris moving through a drainage system and, in particular, is directed to the removal of particles, such as plaster used in dental laboratories, from water as the particles flow through the drainage system.

2. Background Art

A number of devices have been developed which filter unwanted substances from a fluid as the fluid passes therethrough. Such a device is provided in U.S. Pat. No. 3,212,644 to Kemper which also teaches that the trap disclosed therein is used in dental laboratories to remove plaster and wax from water. However, the trap or container itself must be cleaned to remove debris therefrom once it is filled. U.S. Pat. No. 1,796,532 to Nugent shows a series of filtering bags for removing debris from oil. In U.S. Pat. No. 3,362,536 to Sellman a replaceable filter element is shown for use in the cooling system of an internal combustion engine.

DISCLOSURE OF THE INVENTION

In accordance with this invention, a container holding a replaceable trap bag therein is provided for removing debris from a fluid. The container is removably connected between fluid-carrying pipes. At an inlet of the container the fluid delivers the debris which remains in the trap bag while the fluid continues to move through an outlet in the container.

More particularly, a supporting container house therein a replaceable trap bag. The supporting container includes a cover member connected to and overlying a receptacle. The cover member has an inlet for receiving an inlet pipe and an outlet for receiving an outlet pipe. The receptacle has an opening in the side thereof and is substantially frustum shaped to hold the trap bag. The trap bag is also generally frustum shaped while a valve member integral therewith overlies an aperture in the trap bag. The trap bag aperture is placed coaxial with the receptacle opening. The trap bag further includes a seal portion formed along the longitudinal axis of the trap bag. The seal portion has a flat seal portion which is positioned adjacent a rim of the receptacle when the trap bag is placed in the receptacle. The flat seal portion has substantially the same thickness as that of the trap bag while the remaining or raised seal portion extends laterally from the trap bag and is, consequently, of a greater width than the flat seal portion. After placement of the trap bag into the receptacle, the cover member is placed thereover. A gasket member connected to the cover member engages the portion of the trap bag overlying the receptacle rim, including the flat seal portion of the trap bag. A clamping arrangement secures the cover member to the receptacle.

In operation, the supporting container is connected to an inlet pipe which carries the fluid and debris and an outlet pipe which receives the fluid after it has deposited the debris in the trap bag. Eventually, the trap bag is filled with debris and must be removed. The valve member is opened to allow any water near the top portion of the receptacle to drain. The clamping arrangement can then be released so that the receptacle is unconnected from the cover member. The trap bag with debris therein is removed from the receptacle. The pair of straps attached to the outside of the trap bag are positioned to surround the mouth of the trap bag. These straps are subsequently tied together thereby closing off the mouth. The trap bag is then disposed of and another replaceable trap bag is placed in the receptacle. The receptacle is fastened to the cover member to again act as a debris catching element.

In view of the foregoing, it is readily apparent that the present invention provides a number of worthwhile advantages. A debris catching device is provided which is connectable to standard plumbing fixtures. The receptacle of the device is quickly and efficiently removed from a cover member which remains fastened to the fluid carrying pipes. A trap bag is housed within the receptacle and is inexpensively replaced when filled with debris. Significantly, the trap bag includes a flat seal portion along the raised longitudinal seal portion of the trap bag. This flat portion is positioned between the gasket member and the rim of the receptacle to assure a tight seal between the gasket member and the trap bag. If the raised seal portion, having a width greater than the width of the remaining portions of the trap bag overlying the rim, were placed over the rim, it would act as a wedge preventing a tight seal between the gasket member and the trap bag. Without a tight seal, the likelihood of fluid leakage is greatly increased. The trap bag also includes a valve to permit the draining of fluid near the top of the receptacle so it is not spilled when the debris-filled receptacle is removed from the cover member. Finally, straps integral with the trap bag are provided to tie the filled bag to thereby close off the mouth of the bag and facilitate the carrying thereof.

Additional advantages of this invention are readily apparent from the following description taken in conjunction with the accompanying drawings.

BEST MODE FOR CARRYING OUT THE INVENTION

Figure 1:
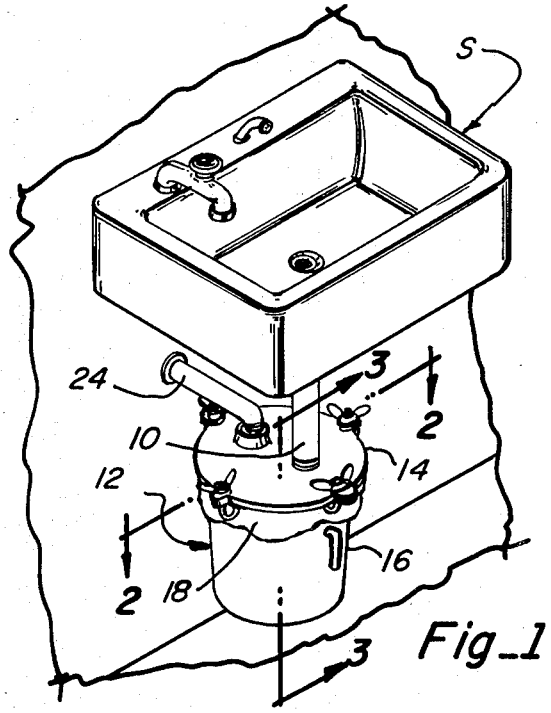
FIG. 1 is a perspective view of the container and trap bag of this invention attached to conventional pipes beneath a drainage sink.

In accordance with the present invention, a conventional sink S is provided as shown in FIG. 1 mounted to a wall structure. A first or inlet pipe 10 is threadably connected to an outlet of the sink S into which fluid or other substances move from the sink S. Beneath the sink S is a supporting container 12 which includes a cover member 14 and a receptacle 16. A trap bag 18 is placed within receptacle 16 with a portion thereof extending outwardly and down the sides of the receptacle 16.

Figure 2:
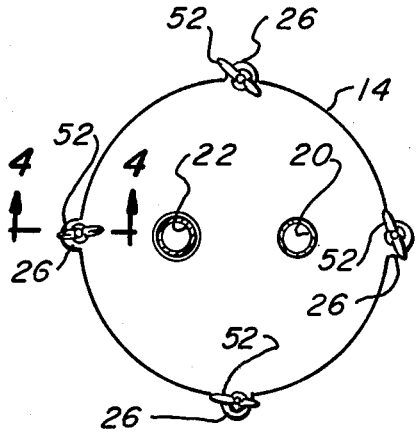
FIG. 2 is an enlarged top plan view, taken along line 2—2 of FIG. 1, showing the cover member.

FIG. 2 shows the generally flat, circular cover member 14 having a recessed, threaded inlet 20 which threadably receives the inlet pipe 10 and extends vertically below the flat portion of cover member 14 to facilitate the delivery of fluid into trap bag 18. A threaded outlet 22 is also formed in cover member 14 and extends vertically above the flat portion of cover member 14 in a direction opposite that of inlet 20 to readily facilitate the receiving of second or outlet pipe 24 which is a standard plumbing fixture. Inlet 20 and outlet 22 are readily connected to pipes already present in the drainage system and extensive modification of the plumbing fixtures is substantially prevented when the supporting container 12 is attached beneath the sink S.

Inlet pipe 10 and outlet pipe 24 held in inlet 20 and outlet 22, respectively, maintain supporting container 12 above a floor surface. The supporting container 12 is held above the floor surface for a distance convenient to permit easy removal of receptacle 16 from cover member 14 when trap bag 18 is filled with debris as will be subsequently discussed.

Figure 3:
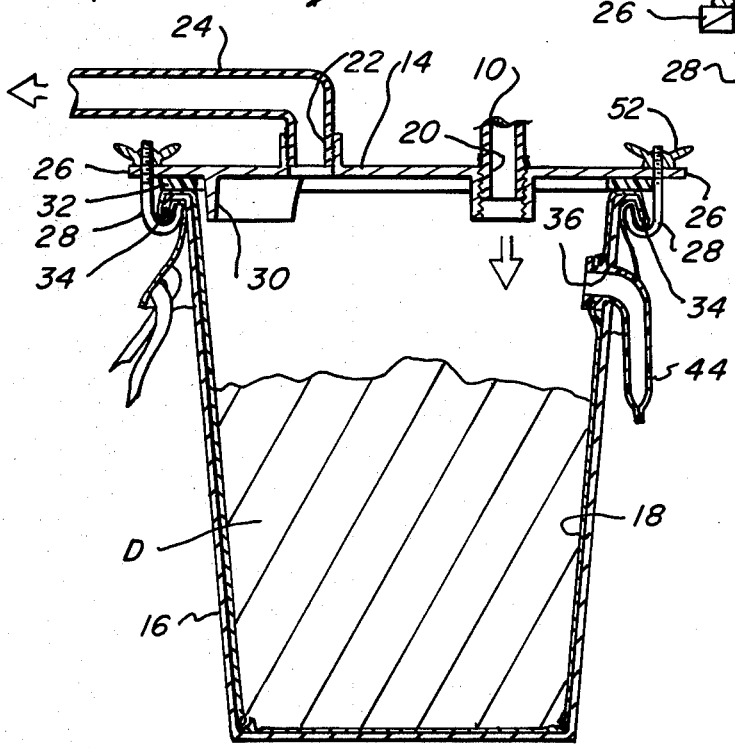
FIG. 3 is an enlarged, longitudinal section, taken along line 3—3 of FIG. 1, showing details of the container and the trap bag having debris held therein with the arrows indicating the direction of fluid movement.
Figure 4:
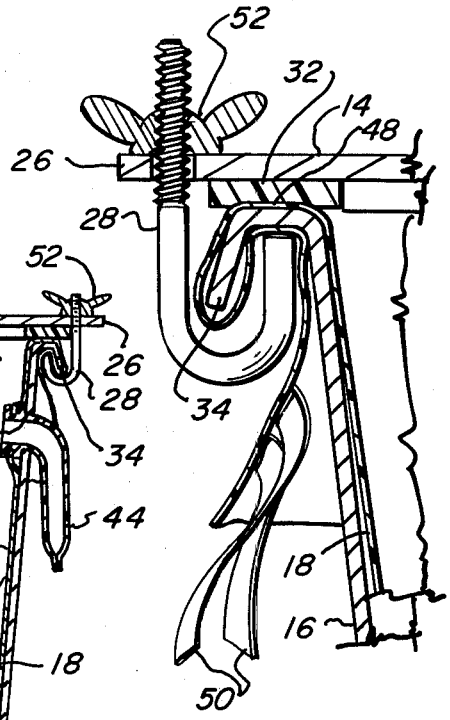
FIG. 4 is a fragmentary, greatly enlarged, longitudinal section taken along line 4—4 of FIG. 2, showing details of the cover member fastened to the receptacle with portions of the trap bag held therebetween.

Cover member 14 further includes projection members 26 extending from the circumference thereof and integral therewith. Projection members 26 have holes centrally formed therein for receiving J-shaped bolts 28. When cover member 14 is placed over receptacle 16, the projection members 26 extend laterally therebeyond, as best seen in FIG. 4. A number of flanges 30, as shown in FIG. 3, are integrally formed on that surface of cover member 14 which is positioned adjacent receptacle 16 to guide and secure the cover member 14 against the inside surface of the receptacle 16. A gasket member 32 is connected by conventional means, such as glue, to the periphery of the cover member 14 along the same surface thereof as flanges 30.

Figure 7:
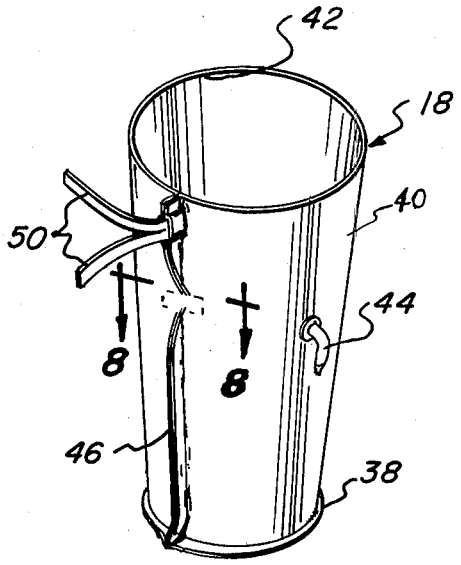
FIG. 7 is an enlarged, perspective view of the trap bag with its mouth in the open position showing the flat seal portion formed along the raised seal portion.

As depicted in FIG. 3, receptacle 16 has a frustum shape with a rim 34 at the top thereof to engage an end of J-bolt 28 against the underside of the rim 34. Receptacle 16 also has an opening 36 formed at a relatively short distance below the rim 34. Trap bag 18, as best seen in FIG. 7, is placed within supporting container 12 prior to positioning cover member 14 over receptacle 16. Trap bag 18 is also generally frustum shaped to readily fit into receptacle 16 and includes a first or bottom segment 38 sealingly connected to a second or upper segment 40. The diameter of bottom segment 38 is less than the diameter of closable mouth 42 when mouth 42 of trap bag 18 is in its completely opened position. Mouth 42 is located at the top portion of the trap bag 18. A valve member 44 is sealingly attached to trap bag 18 overlying an aperture therein. The valve member 44 is tubular shaped and heat sealed at the end, opposite the valve member end attached to the trap bag 18, to prevent leakage therefrom until drainage of the trap bag 18 is desired. The valve member 44 is positioned adjacent the top portion of the trap bag 18 so that, when the trap bag 18 is placed in receptacle 16, a portion of trap bag 18 extends downwardly along the outer surface of receptacle 16 while valve member 44 is inserted through opening 36 in receptacle 16.

Figure 8:
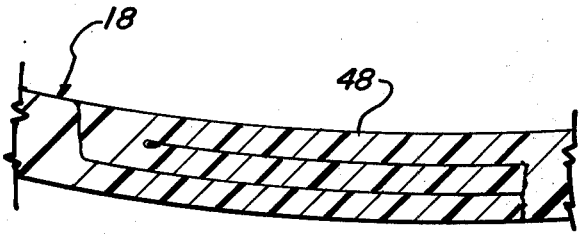
FIG. 8 is a greatly enlarged, fragmentary view, taken along line 8—8 of FIG. 7, showing the flat seal portion having substantially the same thickness as the trap bag.

Upper segment 40 of trap bag 18 has a longitudinal raised seal portion 46 resulting from the formation of the trap bag 18. A flat seal portion 48 is formed along the path of the raised seal portion 46. Raised seal portion 46 extends laterally, outwardly from the outer surface of upper segment 40 and, therefore, is of a greater width than the remaining portions of upper segment 40. Flat seal portion 48, on the other hand, is of substantially the same width or thickness as that of the remaining portions of the upper segment 40 of trap bag 18, as best seen in FIG. 8. This is a salient feature of the trap bag 18 since the flat seal portion 44 overlies rim 34. Consequently, when gasket member 32 is forced against the portion of upper segment 40 of trap bag 18 overlying rim 34, a tight, uniform seal is provided along the entire surface of ring-shaped gasket member 32 against the portions of trap bag 18. It can be readily appreciated that if raised seal portion 46 were positioned contiguously between rim 34 and gasket member 32, rather than flat seal portion 48, the raised seal portion 46 could act as a wedge between the gasket member 32 and the trap bag 18 since it has a greater width than other portions of upper segment 40 overlying rim 34. The formation of a tight, uniform seal would thereby be substantially prevented and fluid leakage from the trap bag 18 adjacent the area of the raised seal portion 46 could obviously result. Trap bag 18 further includes a pair of straps 50 attached along the raised seal portion 46 adjacent the flat seal portion 48. Straps 50 are also positioned outside the receptacle 16 when the trap bag 18 is placed therein.

Once the trap bag 18 is properly positioned in receptacle 16, cover member 14 is placed over the open top portion of receptacle 16. As seen in FIGS. 3 and 4, gasket member 32 contacts that portion of upper segment 40 of trap bag 18 which overlies rim 34. An end of each J-bolt 28 is positioned to underlie a portion of upper segment 40 that extends outside receptacle 16. A wing nut 52 is positioned on the threaded end of each J-bolt 28 and each wing nut 52 is rotated toward one of the projection members 26 so that the other end of J-bolt 28 grippingly engages the under surface of rim 34 to thereby hold cover member 14 against receptacle 16. Gasket member 32 is made of a thin, soft, flexible material so that the pressing action of cover member 14 by means of J-bolt 28 against portions of trap bag 18 provides a tight seal between gasket member 32 and trap bag 18.

The arrows of FIG. 3 indicate the movement of fluid into receptacle 16 through inlet pipe 10. Debris D contained in the fluid is deposited in the trap bag 18, which surrounds the inner surface of receptacle 16, since the debris D is substantially heavier than the fluid, such as water. Upon reaching the top of the receptacle 16, the fluid has an outlet path through outlet pipe 24. It is easily appreciated that supporting container 12 with trap bag 18 can be used in dental-related facilities in which large amounts of plaster or other heavy waste material is flushed with water down a drainage sink.

Figure 5:
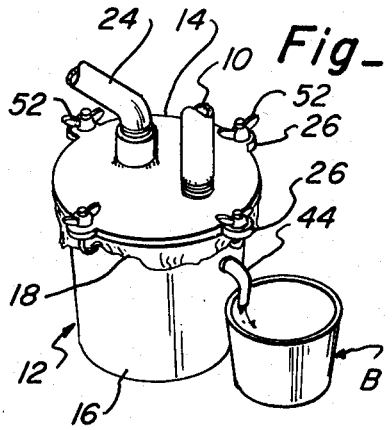
FIG. 5 is a perspective view of the container and trap bag showing the removal of the fluid from the top portion thereof.
Figure 6:
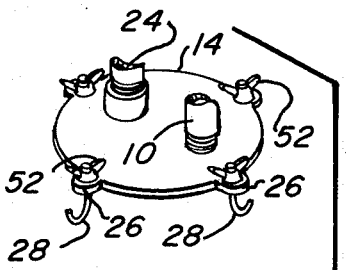
FIG. 6 is an exploded view showing the arrangement of the receptacle, trap bag and cover member.
Figure 6:
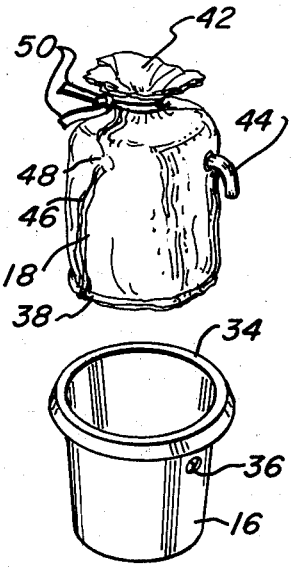

Periodically, trap bag 18 is filled with debris D so that it must be removed from receptacle 16 and replaced. As illustrated in FIG. 5, an end portion of valve member 44 is first removed, typically, by cutting the tip thereof. Any fluid contained in the top portion of trap bag 18 flows out of valve member 44 into a conventional fluid-containing member such as a bucket B. Subsequently, as depicted in FIG. 6, cover member 14 is removed from receptacle 16 by releasing the clamping arrangement of J-bolts 28. Straps 50 are then wrapped around trap bag 18 and tied together thereby closing off mouth 42. Valve member 44 is pulled back through opening 36 of receptacle 16 so that trap bag 18 can be removed from receptacle 16 without any obstructions. An empty trap bag 18 can then be properly placed in receptacle 16 as previously discussed. Receptacle 16 is then reconnected to cover member 14 which remains fastened to inlet pipe 10 and outlet pipe 24.

The supporting container 12 is preferably made of a light weight aluminum construction for easy handling and maneuverability. The J-bolts and wing nuts are typically composed of stainless steel for strong and long-lasting use. The trap bag is of a vinyl construction so that it is readily and properly placed in receptacle 16 and inexpensively replaced when it becomes filled with debris. The flat seal portion of the trap bag upper segment is conveniently formed by the application of pressure and heat along that portion of the raised seal portion which is to overlie the receptacle rim.

Based on the foregoing description, worthwhile advantages of this invention are easily discernable. A debris catching device is provided which is quickly and efficiently attached to existing standard plumbing fixtures. The device prevents unwanted debris or particles from passing through a fluid-carrying system thereby substantially eliminating the clogging thereof. Furthermore, the debris containing trap bag and receptacle are easily removed when the trap bag is filled with debris. Consequently, the time required to remove the debris is significantly minimized and the person removing the debris is subjected to any pungent odor caused by the debris for only a short period of time.

An additional advantage of this device is the valve member of the trap bag which permits the draining of any fluid held in the top portion of the trap bag. Thus, when the debris holding receptacle is removed from the cover member, no fluid accidentally spills from the trap bag onto the floor surface. A significant feature of this device is the flat seal portion of the trap bag which assures a uniform, leak-proof seal along that portion of the trap bag which engages the gasket member.

This invention has been described in detail with reference to a particular embodiment thereof, but it will be understood that various modifications can be effected within the spirit and scope of this invention.

I claim:

1. a trap interposed in a fluid path of a sink drain to remove particles from the fluid and provide for quick and efficient disposal of the particles, comprising:

a receptacle having a rim formed at the top thereof and an opening formed adjacent the top of said receptacle;

a trap bag having an aperture and being held in said receptacle to remove and contain particles from the fluid, said trap bag including an upper segment, a bottom segment sealingly connected to said upper segment and a mouth formed at the top portion of said upper segment, said upper segment having a raised longitudinal seal portion and a flat seal portion located along the path of said raised seal portion while being positioned to overlie said rim, said raised seal portion having a greater width than portions of said upper segment of said trap bag overlying said rim while said flat seal portion being of substantially the same width as portions of said upper segment of said trap bag overlying said receptacle rim;

a generally flat cover member to which the rim of said receptacle is connected to form a closure for the top of said receptacle, said cover member having an inlet connectable to a first pipe to receive fluid which carries particles and an outlet connectable to a second pipe to discharge the fluid after the particles have been deposited in said trap bag;

a gasket member connected to said cover member and positioned contiguously adjacent said flat seal portion of said upper segment of said trap bag overlying said receptacle rim so that, when connecting said cover member to said receptacle, said gasket member provides a tight, uniform seal between said gasket member and said trap bag to substantially prevent leakage of fluid therefrom;

clamping means for releasably fastening said receptacle to said cover; and a valve member sealingly connected to said trap bag overlying said trap bag aperture and being insertable through said opening in said receptacle when said trap bag is placed in said receptacle, said valve member being openable to permit fluid contained in the top portion of said trap bag to drain when said trap bag is filled with particles prior to the removal of said receptacle from said cover member.

2. A trap bag positionable in a supporting container, which is connectable to fluid-carrying inlet and outlet pipes, for removing and containing debris present in the fluid, said trap bag comprising:

an upper segment having a portion thereof positionable inside the supporting container and a portion positionable outside the supporting container;

a bottom segment connected to said upper segment;

a raised seal portion formed along said upper segment and having a width greater than the width of the remaining portions of said upper segment; and a flat seal portion located along the path of said raised seal portion and having a width less than the width of said raised seal portion while being substantially equal in width to the remaining portions of said upper segment, said flat seal portion positionable in the supporting container to minimize leakage of fluid from the trap bag.

3. The trap bag, as claimed in claim 2, further including:

an aperture formed in said upper segment of said trap bag near the top portion thereof; and a valve member sealingly connected to said trap bag while overlying said trap bag aperture, said valve member being insertable through an opening in the supporting container and openable to permit fluid to drain from the top of the supporting container.

4. The disposble container, as claimed in claim 2, further including:

a strap integral with said upper segment of said trap bag to close said mouth thereof when said trap bag is filled with the debris to facilitate the carrying thereof and minimize the spillage of debris therefrom.

* * * * *